US009525201B2

(12) United States Patent
Ganswindt et al.

(10) Patent No.: US 9,525,201 B2
(45) Date of Patent: Dec. 20, 2016

(54) HINGE THAT SERVES AS A RADIATOR

(71) Applicant: Nokia Technologies Oy, Espoo (FI)

(72) Inventors: Erik Ganswindt, San Jose, CA (US); Aycan Erentok, Sunnyvale, CA (US); Anton Olof Fahlgren, San Francisco, CA (US); Veli-Pekka Ronn, Sunnyvale, CA (US)

(73) Assignee: Nokia Technologies Oy, Espoo (FI)

( * ) Notice: Subject to any disclaimer, the term of this patent is extended or adjusted under 35 U.S.C. 154(b) by 234 days.

(21) Appl. No.: 14/524,654

(22) Filed: Oct. 27, 2014

(65) Prior Publication Data

US 2016/0118709 A1 Apr. 28, 2016

(51) Int. Cl.

| | |
|---|---|
| ***H01Q 1/22*** | (2006.01) |
| ***H01Q 1/27*** | (2006.01) |
| ***E05D 7/00*** | (2006.01) |
| ***E05D 11/00*** | (2006.01) |

(52) U.S. Cl.

CPC ..... *H01Q 1/22* (2013.01); *E05D 11/0081* (2013.01); *H01Q 1/273* (2013.01)

(58) Field of Classification Search

CPC ..... H01Q 1/22; H01Q 1/273; E05D 11/0081
See application file for complete search history.

(56) References Cited

U.S. PATENT DOCUMENTS

| | | | |
|---|---|---|---|
| 4,625,212 | A | 11/1986 | Oda et al. |
| 4,947,179 | A | 8/1990 | Ganter et al. |
| 5,134,724 | A | 7/1992 | Gehring et al. |
| 5,152,693 | A | 10/1992 | Matsui et al. |
| 5,170,173 | A | 12/1992 | Krenz et al. |
| 5,280,296 | A | 1/1994 | Tan et al. |
| 5,450,091 | A | 9/1995 | Hama |
| 5,499,398 | A | 3/1996 | Kudoh et al. |
| 5,541,399 | A | 7/1996 | de Vall |
| 5,627,552 | A | 5/1997 | Farrar et al. |
| 5,757,326 | A | 5/1998 | Koyama et al. |
| 6,107,920 | A | 8/2000 | Eberhardt et al. |
| 6,175,729 | B1 | 1/2001 | He et al. |

(Continued)

FOREIGN PATENT DOCUMENTS

| | | |
|---|---|---|
| EP | 1 221 825 A1 | 7/2002 |
| EP | 2 720 316 A1 | 4/2014 |

(Continued)

OTHER PUBLICATIONS

Antonino-Daviu, E. et al., *Novel Antenna for Mobile Terminals Based on the Chassis-Antenna Coupling*, IEEE (2005) 4 pages.

(Continued)

*Primary Examiner* — Hoang V Nguyen
*Assistant Examiner* — Michael Bouizza
(74) *Attorney, Agent, or Firm* — Alston & Bird LLP

(57) ABSTRACT

A hinge of a device is provided that serves as a radiator. The hinge includes first and second conductive pin elements. The opposite ends of the first and second conductive pin elements are configured to mechanically engage the device. The hinge also includes an insulator between portions of the first and second conductive pin elements. The end of at least the first conductive pin element is also configured to be in electrical communication with radio frequency circuitry of the device such that the first conductive pin element functions as the radiator.

21 Claims, 5 Drawing Sheets

(56) References Cited

U.S. PATENT DOCUMENTS

| | | | | |
|---|---|---|---|---|
| 6,181,287 | B1 | 1/2001 | Beigel | |
| 6,272,356 | B1 * | 8/2001 | Dolman | H01Q 1/084 343/702 |
| 6,350,055 | B1 | 2/2002 | Barras | |
| 6,634,786 | B2 | 10/2003 | Dinger et al. | |
| 6,642,895 | B2 | 11/2003 | Zurcher et al. | |
| 6,850,773 | B1 | 2/2005 | Ghassabian | |
| 6,914,564 | B2 | 7/2005 | Barras et al. | |
| 6,980,162 | B1 | 12/2005 | Laaksonen | |
| 7,030,823 | B2 | 4/2006 | Apotheloz et al. | |
| 7,068,237 | B2 | 6/2006 | Fukuda | |
| 7,126,550 | B2 | 10/2006 | Clerc et al. | |
| 7,162,217 | B2 | 1/2007 | Bisig | |
| 7,463,205 | B2 | 12/2008 | Turner et al. | |
| 8,073,548 | B2 | 12/2011 | Colvin, Jr. et al. | |
| 8,325,015 | B2 | 12/2012 | Hall | |
| 2003/0234743 | A1 | 12/2003 | Ponce De Leon et al. | |
| 2004/0238648 | A1 | 12/2004 | Chen | |
| 2008/0143609 | A1 * | 6/2008 | Mashima | H01Q 1/243 343/702 |
| 2010/0073243 | A1 | 3/2010 | Ayala Vazquez et al. | |
| 2010/0095522 | A1 | 4/2010 | Lerch et al. | |
| 2011/0057043 | A1 | 3/2011 | Weakley | |
| 2012/0056719 | A1 | 3/2012 | Krishna et al. | |
| 2012/0056792 | A1 | 3/2012 | Han | |
| 2014/0292613 | A1 | 10/2014 | Hsiao et al. | |

FOREIGN PATENT DOCUMENTS

| | | | |
|---|---|---|---|
| WO | WO 99/35857 | A1 | 7/1999 |
| WO | WO 2014/065896 | A1 | 5/2014 |

OTHER PUBLICATIONS

International Search Report and Written Opinion for corresponding International Application No. PCT/FI2015/050723, dated Jan. 29, 2016.

Jin, P. et al., *Low-Q, Electrically Small, Efficient Near-Field Resonant Parasitic Antennas*, IEEE Transactions on Antennas and Propagation, vol. 57, No. 9 (Sep. 2009) 2548-2563.

Li, H. et al., *Decoupling of Multiple Antennas in Terminals With Chassis Excitation Using Polarization Diversity, Angle Diversity and Current Control*, IEEE Transactions on Antennas and Propagation., vol. 60, No. 12 (Dec. 2012) 5947-5957.

Sullivan, P. L. et al., *Analysis of an Aperture Coupled Microstrip Antenna*, IEEE Transactions on Antennas and Propagation, vol. AP-34, No. (Aug. 1986) 977-984.

Zhong, J. et al., *Multiband Slot Antennas for Metal Back Cover Mobile Handsets*, Progress in Electromagnetics Research Letters, vol. 39 (2013) 115-126.

* cited by examiner

HINGE THAT SERVES AS A RADIATOR

TECHNOLOGICAL FIELD

A hinge is provided in accordance with an example embodiment and, more particularly, a hinge that serves as a radiator is provided in accordance with an example embodiment of the present invention.

BACKGROUND

People employ a wide variety of wearable devices. These wearable devices may include watches, bracelets, necklaces, armbands or the like. The wearable device may alternatively be included within clothing, such as by being embedded in sleeving or a collar, or the leg of a pair of pants. In addition to being ornamental, the wearable devices may, in some instances, be configured to perform a variety of functions. For example, wearable devices may support functions related to entertainment, such as playing music; communication, such as supporting voice calls, text messaging or the like; or health or exercise, such as monitoring and recording heart rate, blood pressure, distance traveled or the like.

At least some of the functions performed by wearable devices may require communication offboard the wearable device. In at least some instances, communication offboard the wearable device is to be provided wirelessly. In this regard, a wearable device may be in communication, such as wireless communication, with another communication device carried by the user, such as a cellular telephone carried by the user. While the cellular telephone may support communication with the wearable device, some users may not wish to carry an additional communication device, such as the cellular telephone, particularly in instances of which the user is exercising or in which carrying the cellular telephone would otherwise be inconvenient. As such, some wearable devices may communicate directly with another device, such as a base station or access point node, without support by a cellular telephone or the like. In either instance, the wearable device may require one or more radiators in order to wirelessly transmit and/or receive signals. However, the incorporation of a radiator within a wearable device may be complicated by the relatively small size of at least some wearable devices as well as other competing requirements, such as the aesthetic appearance of the wearable device.

BRIEF SUMMARY

A hinge of a device, such as a wearable device, is therefore provided that serves as a radiator. By incorporating the radiator or part of the radiator within the hinge of the device, the device supports communication, such as offboard or onboard the device, in a manner that does not impair the functionality or aesthetic appearance of the device, such as a wearable device. Instead, the hinge of an example embodiment may serve the dual purposes of mechanically interconnecting the body and band of a wearable device, while also serving as a radiator to support wireless communications.

In an example embodiment, a hinge of a device that serves also as a radiator is provided that includes first and second conductive pin elements. The opposite ends of the first and second conductive pin elements are configured to mechanically engage the wearable device. The hinge of this example embodiment also includes an insulator between portions of the first and second conductive pin elements. For example, the first and second conductive pin elements may extend in opposite directions from the insulator to the ends that are configured to mechanically engage the device. The end of at least the first conductive pin element is also configured to be in electrical communication with radio frequency circuitry of the device such that the first conductive pin element is a radiating element.

The first and second conductive pin elements of an example embodiment may include an outer conductor that defines an interior passageway that extends in a lengthwise direction. The first and second conductive pin elements of this example embodiment may also include an inner conductor that extends at least partially through the interior passageway. At least one of the first and second conductive pin elements of this example embodiment may also include a shielding within the interior passageway between the outer conductor and the inner conductor. The inner conductor of the first conductive pin element of this example embodiment may include the end that is configured to be in electrical communication with the radio frequency circuitry. The inner conductor of this example embodiment may be galvanically connected to the outer conductors of the first and second conductive pin elements. The insulator of this example embodiment may also define a passageway therethrough through which the inner conductor extends. In another embodiment, a galvanically isolating gap is defined between the first and second conductive pin elements. The insulator of an example embodiment may be disposed between the first and second conductive pin elements and may surround at least portions of the first and second conductive pin elements. In an example embodiment, the first and second conductive pin elements may include respective biasing members configured to bias the ends away from the insulator and into mechanical engagement with the wearable device.

In another example embodiment, a hinge of a device that serves as a radiator is provided. The hinge for this example embodiment includes first and second conductive pin elements. The first and second conductive pin elements include an outer conductor that defines an interior passageway that extends in a lengthwise direction. The first and second conductive pin elements also include an inner conductor that extends at least partially through the interior passageway. At least one of the first and second conductive pin elements may also include a shielding within the interior passageway between the outer conductor and the inner conductor. The hinge of this example embodiment also includes an insulator between the outer conductors of the first and second conductive pin elements. The first and second conductive pin elements extend in opposite directions from the insulator to respective ends that are configured to mechanically engage the device. The end of at least the first conductive pin element is also configured to be in electrical communication with radio frequency circuitry of the device such that the first conductive pin element is a radiating element.

The inner conductor of the first conductive pin element may include the end that is configured to be in electrical communication with the radio frequency circuitry. The inner conductor of this example embodiment may be connected to the outer conductor of the second conductive pin element. The insulator of an example embodiment may define a passageway therethrough through which the inner conductor extends. In this example embodiment, at least a portion of the passageway defined by the insulator may be larger than the inner conductor such that a gap is defined between the inner conductor and the insulator. In an example embodiment, the insulator may be dispensed between the first and second conductive pin elements and may surround at least portions of the first and second conductive pin elements. The outer conductor of the first and/or second conductive pin elements may be galvanically connected to the device, such as a body of the device, or to at least one of the transmitter and the receiver.

The device may include a wearable body and a band. The respective ends of the first and second conductive pin elements of this example embodiment may each be configured to mechanically engage the wearable body. The hinge of this example embodiment may be configured to be operatively coupled to the band, thereby joining the band and the wearable body.

In a further example embodiment, a hinge of a device is provided that includes first and second conductive pin elements that include respective ends. At least one end is configured to be deflected. The hinge of this example embodiment also includes an insulator between portions of the first and second conductive pin elements. The first and second conductive pin elements extend in opposite directions from the insulator to the respective ends that are configured to mechanically engage the device. The end of at least the first conductive pin element is also configured to be in electrical communication with radio frequency circuitry of the device such that the first conductive pin element is a radiating element.

The first and second conductive pin elements of an example embodiment include respective biasing members configured to bias the respective ends away from the insulator and into mechanical engagement with the device. The first and second conductive pin elements of an example embodiment may define internal cavities with the respective ends disposed at least partially within the internal cavities. In this example embodiment, the first conductive pin may also include an interior end, opposite the end that is in mechanical engagement with the device. The interior end of this example embodiment closes the internal cavity of the first conductive pin and is disposed within the internal cavity of the second conductive pin element. The interior end of the first conductive pin may be separated in accordance with this example embodiment from the second conductive pin by the insulator.

The device may include a wearable body and a band. The respective ends of the first and second conductive pin elements of this example embodiment may each be configured to be mechanically engaged with the wearable body. The hinge of this example embodiment may be configured to be operatively coupled to the band, thereby joining the band and the wearable body.

BRIEF DESCRIPTION OF THE DRAWINGS

Figure 1:
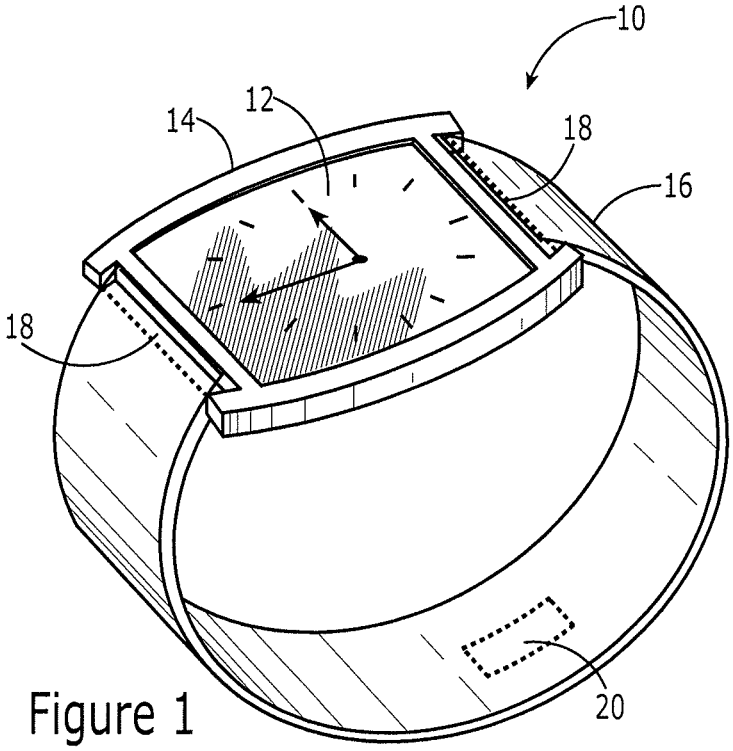
Figure 2:
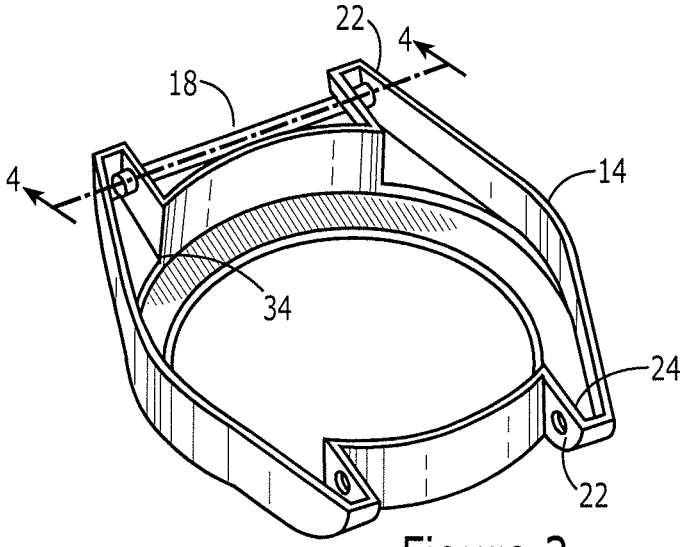
Figure 3:
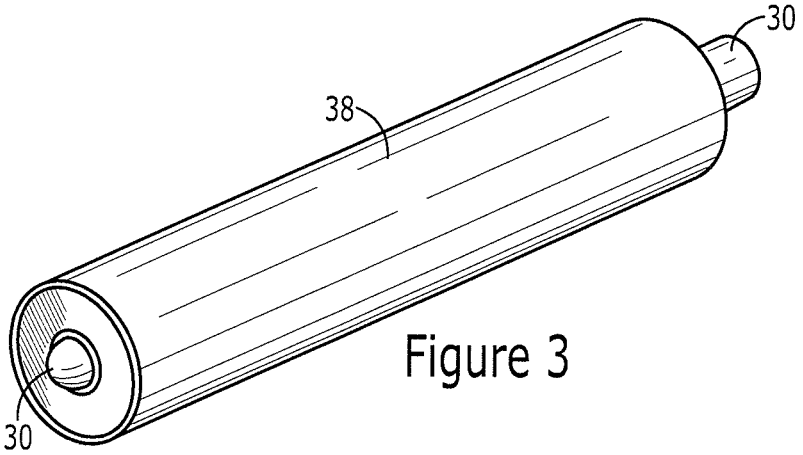
Figure 4:
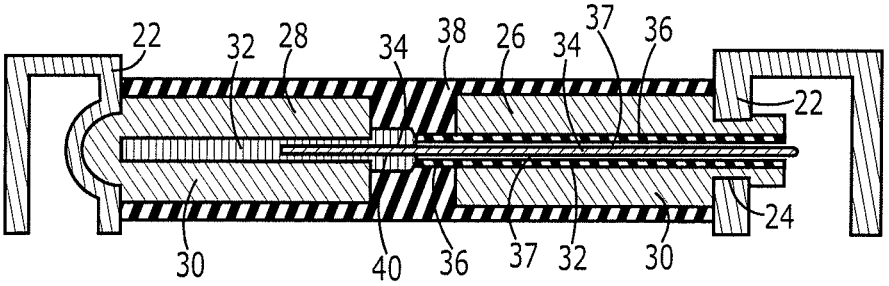
Figure 6:
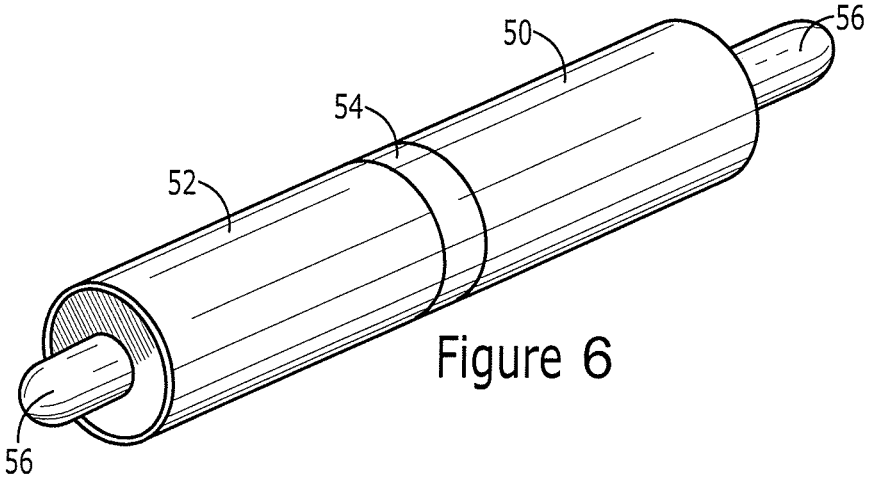
Figure 5:
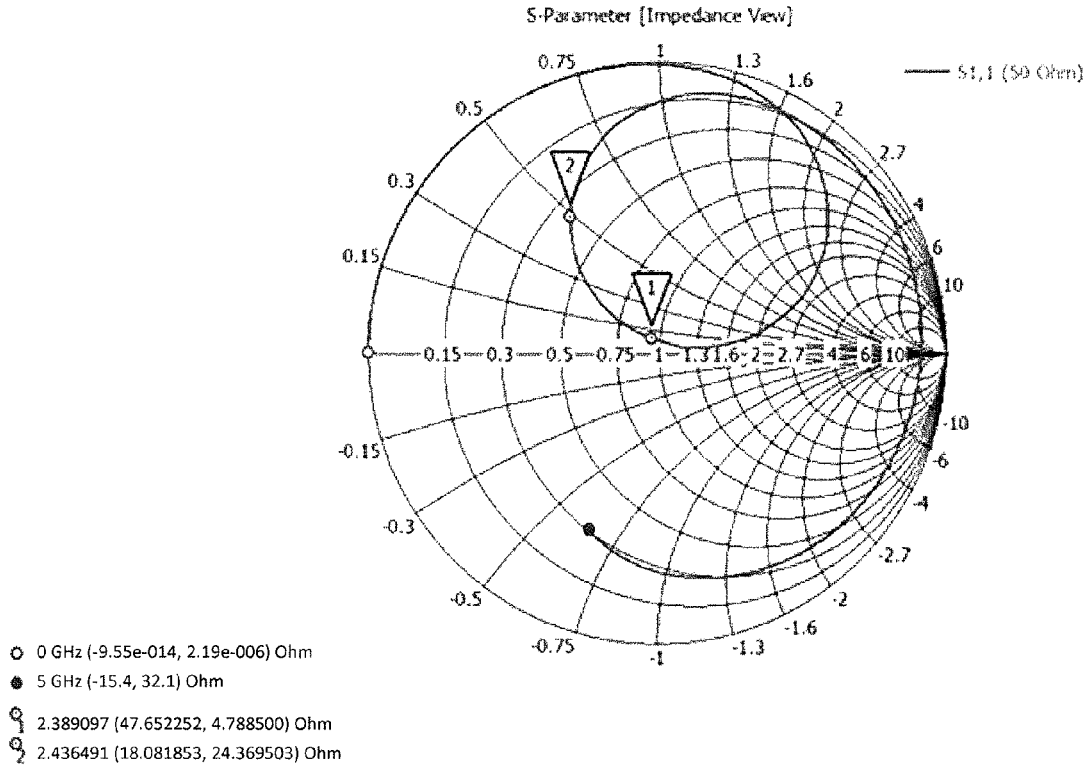
Figure 7:
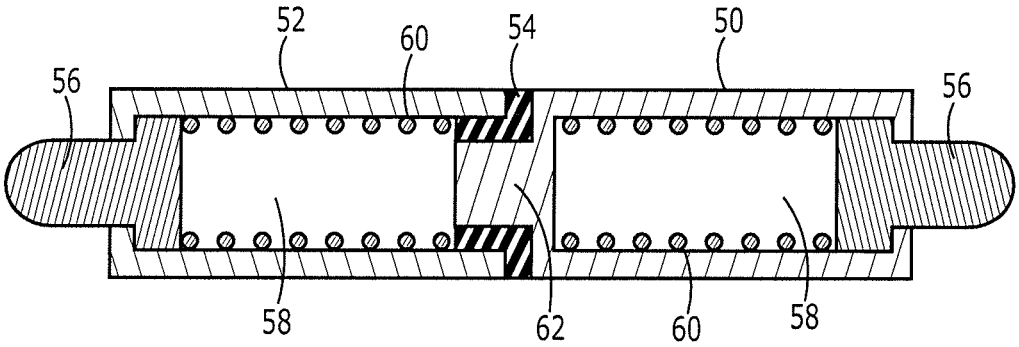

Having thus described certain embodiments of the invention in general terms, reference will now be made to the accompanying drawings, which are not necessarily drawn to scale, and wherein:

FIG. 1 is a perspective view of a wearable device having a hinge that serves as a radiator in accordance with an example embodiment of the present invention;

FIG. 2 is a perspective view of a hinge in accordance with an example embodiment of the present invention and a wearable body of a wearable device with which the hinge is mechanically engaged;

FIG. 3 is a perspective view of a hinge in accordance with an example embodiment of the present invention in which the hinge serves as a radiator with inductive reactance at a certain operational bandwidth;

FIG. 4 is a cross-sectional view of the hinge of FIG. 3 as taken along line 4-4 of FIG. 2;

FIG. 5 is a Smith chart of the inductive reactance of a radiator in accordance with an example embodiment of the present invention in which a plurality of points are labeled in terms of frequency (GHz) and the real and imaginary components of impedance (Ohms);

FIG. 6 is a perspective view of a hinge in accordance with an example embodiment of the present invention in which the hinge serves as a radiator with capacitive reactance at a certain operational bandwidth;

FIG. 7 is a cross-sectional view of the hinge of FIG. 6; and

Figure 8:
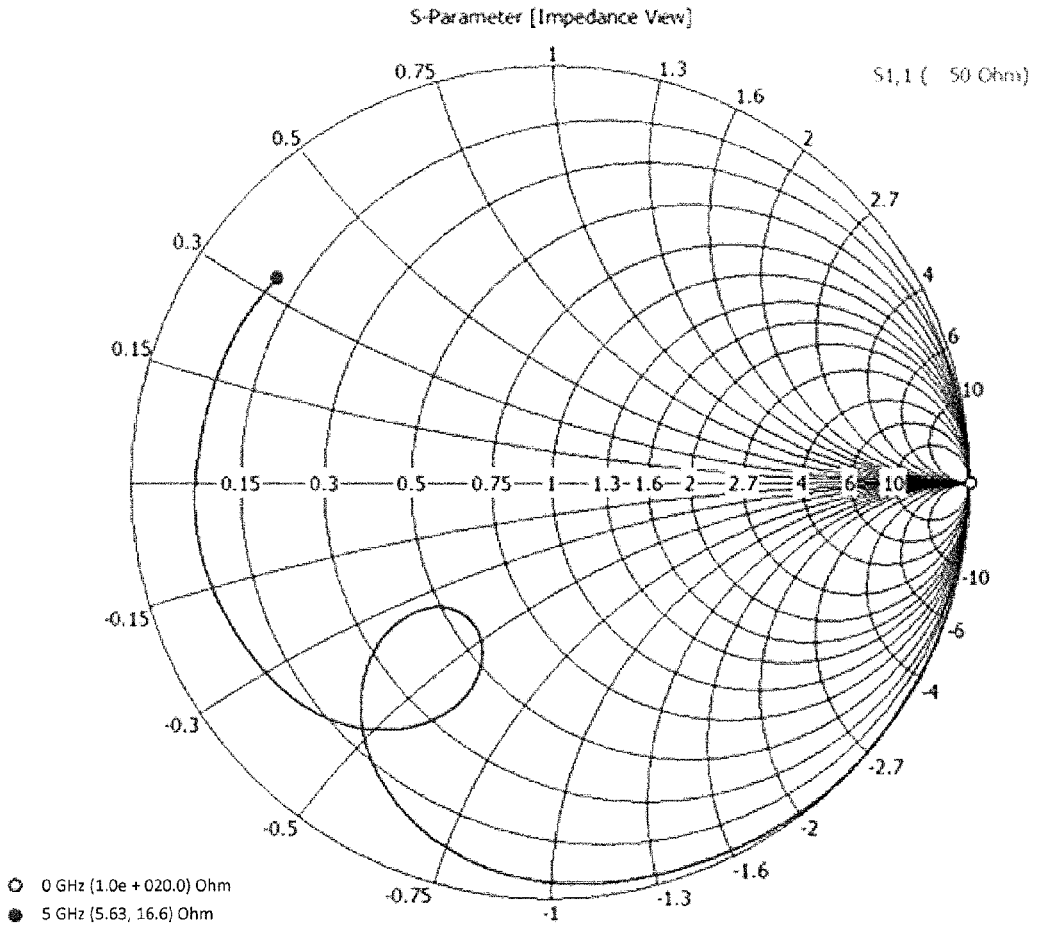

FIG. 8 is a Smith chart of the capacitive reactance of a radiator in accordance with an example embodiment of the present invention in which a plurality of points are labeled in terms of frequency (GHz) and the real and imaginary components of impedance (Ohms).

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

A hinge of a device is provided in accordance with an example embodiment in order to serve as a radiator on its own without the need for further conductors or radiators, such as to directly communicate offboard the device with another device, e.g., a cellular telephone, a base station or an access point node, or to communicate with another conductor carried by the device that serves, along with the radiator of the hinge, as an antenna. The hinge may be a component of a variety of different devices. As described below by way of example, but not of limitation, the hinge may be a component of a wearable device. Alternatively, the hinge may be a component of other devices that are not wearable, such as the hinge of a portable electronic device, e.g., a foldable mobile telephone, the hinge of a personal computer or the like.

A wearable device 10 is depicted in FIG. 1 for purposes of illustration, but not a limitation. In this example embodiment, the wearable device is a watch or other wrist worn accessory. However, the wearable device may be any of a wide variety of wearable devices, such as an armband, a necklace or the like. Alternatively, the wearable device may be integrated into a garment or clothing (not illustrated in FIG. 1) such that the wearable device is wrapped around the periphery of a sleeve of the garment or any other part of the garment, such as a collar or a pant leg, as non-limiting examples. Regardless of the type of wearable device, the wearable device of an example embodiment is configured to support communications, such as communications offboard the wearable device. Thus, the wearable device includes one or more radiators for transmitting and/or receiving signals. As such, the wearable device of an example embodiment may be multi-functional, such as by supporting communications as well as performing one or more other functions, such as entertainment, e.g., playing audio and/or video files; communications, e.g., voice communications, text messaging or the like; health or other body monitoring applications, etc. Further, the wearable device may, in some instances, also serve an ornamental or aesthetic function.

In the example embodiment, the wearable device 10 includes a wearable body 12, such as a watch, an interactive user interface, a music and/or a video player, a communication device, a printed wiring board (PWB), a computing device or the like. As shown more clearly in FIG. 2, for example, the wearable body may include a chassis or frame 14 that is configured to receive a component, such as a watch, a user interface, a communication module, a printed wiring board, a computing device or the like. Additionally, the wearable device of the example embodiment may include a band 16, such as for attaching the wearable device to the arm, wrist, ankle, waist, head or other portion of the user. In order to interconnect the band and the wearable body, the wearable device may also include one or more hinges 18 that mechanically engages the wearable body 12, such as the chassis 14 of the wearable body 16, and is also affixed to the band, thereby permitting relative motion of the band with respect to the chassis while mechanically joining the band and the wearable body. As described below, the hinge may serve as at least a part of a radiator for the wearable device, thereby supporting communications, such as communications offboard the wearable device, either directly or via another radiator carried by the wearable device. For example, the wearable device may directly communicate with another device, e.g., a base station, an access point node or the like, or may communicate with via a cellular telephone or another intermediate communications device with a base station, an access point node or the like.

Although the hinge 18 may be configured in various manners, the hinge of an example embodiment is depicted in FIGS. 3 and 4. As described below, the hinge of this example embodiment serves as a radiator having an electrically small length that has an inductive reactance for a certain operational bandwidth. As illustrated in FIG. 4, the hinge includes first and second conductive pin elements 26, 28 and an insulator 38 between the first and second conductive pin elements. In an example embodiment, the first and second conductive pin elements may be formed of one or more metals, such as, but not limited to, gold, copper or nickel, and the insulator may be formed of a non-conductive material, for example, and not limited to, a plastic. The opposite ends of the first and second conductive pin elements may be configured to mechanically engage the wearable device 10. For example, the opposite ends of the first and second conductive pin elements may extend into and engage corresponding features defined by the wearable body and, more particularly, by the chassis 14 of the wearable body. The chassis may also be formed of a metal, such as gold or gold plating. In this example embodiment, the chassis may include a pair of tabs 22 spaced apart from one another, such as on opposite sides of the chassis. Like the chassis, the tabs may be formed of a metal, such as gold or gold plating. Each tab may define a hole 24 or other feature that is engaged by an end of a respective conductive pin element. As such, the hinge mechanically engages the wearable body, but permits rotational movement of the hinge and, for example, the band 20 carried by the hinge relative to the wearable body 12.

In the embodiment depicted in FIGS. 3 and 4, the first and second conductive pin elements 26, 28 have a coaxial configuration. In this regard, the first and second conductive pin elements may each include an outer conductor 30, such as formed of a metal, e.g., gold or a gold plating, that defines an interior passageway 32 that extends in a lengthwise direction, that is, that extends between the opposed ends of the first and second conductive pin elements. The first and second conductive pin elements of this example embodiment may be aligned, such as within the insulator 38 as described below such that the interior passageways defined by the first and second conductive pin elements are aligned with one another. In the illustrated embodiment, the first conductive pin element may define the interior passageway such that the interior passageway opens through the respective end thereof. However, the second conductive pin element may differently define the interior passageway such that the interior passageway does not extend through the respective end of the second conductive pin element, but, instead, terminates therewithin.

As shown in FIG. 4, the outer conductors 30 of the first and second conductive pin elements 26, 28 are separated by the insulator 38 and include the respective ends that are configured to mechanically engage with the wearable device 10. In this regard, the end of the first conductive pin element may extend through a hole 24 defined by the wearable body 12, such as a tab 22 of the chassis 14 of the wearable body. The end of the first conductive pin element formed by the outer conductor is galvanically connected to the wearable body, such as to the chassis of the wearable body. The respective end of the outer conductor 30 of the second conductive pin element may also mechanically engage the wearable device, such as the chassis of the wearable device. In the embodiment depicted in FIG. 4, for example, the wearable body, such as the tab of the chassis, may define a cavity or recess that is configured to receive the end of the second conductive pin element, such as with an interference fit, and to permit rotation therebetween. In addition to the mechanical engagement of the respective end of the second conductive pin element and the wearable body, the outer conductor of the second conductive pin element is be galvanically connected to the wearable body, such as to the chassis of the wearable body. As a result of the galvanic connection of the first and second conductive pins to the chassis and, in some embodiments, to radio frequency (RF) circuitry, such as at least one of a transmitter or a receiver as described below, the hinge of this example embodiment has an inductive reactance for a certain operational bandwidth as a result of its loop-like structure with the chassis and/or a PWB carried by the chassis serving as the ground plane.

As a result of its coaxial configuration, the first and second conductive pin elements 26, 28 of this example embodiment may also include an inner conductor 34, such as formed of a metal, e.g., gold, that extends at least partially through the interior passageway 32. In this regard, the same inner conductor may extend at least partially through the interior passageways defined by the outer conductors 30 of both the first and second conductive pin elements. In addition, the insulator 38 between the first and second conductive pin elements that electrically isolates the first and second conductive pin elements may also define a passageway that is aligned with the passageways defined by the outer conductors of the first and second conductive pin elements. Thus, the interior conductor also extends through the passageway defined by the insulator so as to bridge between the outer conductors of the first and second conductive pin elements.

Although the inner conductor 34 may extend through the interior passageway 32 defined by both the first and second conductive pin elements 26, 28, the inner conductor may extend through different lengths of the interior passageways defined by the first and second conductive pin elements. For example, the inner conductor may extend through the entire length of the interior passageway defined by the outer conductor 30 of the first conductive pin element. Conversely, the inner conductor may only extend through a portion, such as a minority, of the length of the interior passageway defined by the outer conductor of the second conductive pin element and be electrically coupled to the outer conductor of the second conductive pin element proximate the end of the inner conductor. As used herein, coupling may include galvanic or electromagnetically coupled mechanisms, and direct and indirect mechanical coupling. In the example embodiment, the inner conductor extends beyond the outer conductor of the first conductive pin element. See, for example, FIG. 4 in which the inner conductor extends beyond the outer conductor. Thus, the inner conductor may be in electrical communication, such as by making electrical contact either galvanically or by a non-galvanic coupling mechanism with RF circuitry, such as a transmitter and/or a receiver, e.g., a transceiver, carried by the wearable body 12. As used herein, coupling may include galvanic or electromagnetically coupled mechanisms, and direct and indirect mechanical coupling.

At least one of the first and second conductive pin elements 26, 28 may also include a shielding 36, such as formed of a metal, such as copper, gold or a gold plating, within the interior passageway 32 between the outer conductor 30 and the inner conductor 34. The shielding may be galvanically connected to the outer conductor. In order to electrically isolate the shielding and the inner conductor, a gap 37 may be defined between the shielding and the inner conductor which, in some embodiments, may be filled with an insulator. In the embodiment depicted in FIGS. 3 and 4, the first conductive pin element may include a shielding that surrounds the inner conductor. As shown in FIG. 4, the shielding of this example embodiment may also extend into the interior passageway of the insulator 38, but does not extend through the entirety of the passageway defined by the insulator. As also shown in FIG. 4, the second conductive pin element need not include shielding between the inner and outer conductors and, instead, the inner conductor may be electrically coupled to the outer conductor of the second conductive pin element, such as proximate the end of the inner conductor.

The passageway defined by the insulator 38 through which the inner conductor 34 extends may include a portion 40 that is larger than the inner conductor so as to define a gap between the inner conductor and the insulator. Within this larger portion of the passageway defined by the insulator, the inner conductor is not shielded such that the portion of the inner conductor extending through the larger portion of the passageway defined by the insulator serves as an electrical or electro-magnetic excitation point.

The insulator 38 of an example embodiment not only is disposed between the outer conductors 30 of the first and second conductive pin elements 26, 28, but may also surround at least portions of the first and second conductive pin elements. For example, the insulator may surround those portions of the outer conductors 30 of the first and second conductive pin elements that extend between the tabs 22 of the chassis 14 of the wearable body 12 that are engaged by the opposed ends of the first and second conductive pin elements.

As described above, the respective ends of the first and second conductive pin elements 26, 28 are each configured to mechanically engage the wearable body 12. Moreover, the hinge 18 is configured to be operatively coupled to the band 16, thereby joining the band to the wearable body and permitting rotational movement therebetween. Additionally, at least one of the conductive pins, such as the first conductive pin, may be a radiating element so that the hinge may serve as a radiator, such as an electrically small loop antenna having inductive reactance for a certain operational bandwidth in the example embodiment of FIGS. 3 and 4. As used herein, a radiating element is any portion of an antenna that is capable of transmitting and/or receiving wireless signals. In order to function as a loop antenna, the inner conductor 34 of the hinge may establish a galvanic connection between the first and second conductive pin elements, such as between the outer conductors 30 of the first and second conductive pin elements. Thus, the loop antenna of this embodiment is formed by the ground plane, such as the chassis 14 and/or the ground plane of the PWB, in addition to the hinge and any intervening conductive elements which couple the hinge to radio frequency (RF) circuitry, e.g., a transmitter and/or a receiver, carried by the wearable body. By way of example, the Smith chart of FIG. 5 illustrates the inductive reactance of the radiator embodied by the hinge of one example embodiment.

The loop antenna of this embodiment may be configured as a balanced loop in which one terminal of the RF circuitry is coupled to the end of the first conductive pin element 26 and the opposite terminal of the RF circuitry is coupled to the end of the second conductive pin element 28. Alternatively, the loop antenna of this embodiment may be configured as an unbalanced or single-ended loop in which the end of one of the first and second conductive pin elements is coupled to the RF circuitry and the end of the other one of the first and second conductive pin elements is connected to ground, such as by being coupled to the chassis or the ground plane of the PWB. In this regard, ground may be a single point, multipoint or seam connection. In an alternative embodiment, the hinge 18 of the embodiment of FIGS. 3 and 4 may be configured such that a galvanically isolating gap is defined between the first and second conductive pin elements, such as by maintaining a galvanically isolating gap between the inner conductor 34 and the outer conductors 30. In this alternative embodiment, the hinge may serve as a balanced dipole in which one terminal of the RF circuitry is coupled to the end of the first conductive pin element and the opposite terminal of the RF circuitry is coupled to the end of the second conductive pin element. Alternatively, the hinge of this alternative embodiment may serve as a single-ended monopole or a near-field coupling or excitation element for another radiator in which the end of only one of the first and second conductive pin elements is coupled to the RF circuitry with the end of the other one of the first and second conductive pin elements remaining open or unconnected.

As a result of its inductive reactance for a certain operational bandwidth, the hinge may operate as a radiator so as to transmit signals from the circuitry and/or to receive signals for the circuitry. As a result of its size, the hinge may operate as a radiator at relatively high frequencies. Alternatively, the hinge may function as an electromagnetic source and be electromagnetically coupled to another radiator, such as a radiator 20 carried by, e.g., embedded within, the band. The hinge radiator in combination with the further radiator thereby forms an overall antenna which is configured to operate at a lower resonant frequency than that of the resonant frequency provided by either the hinge radiator or the resonant frequency provided by the further radiator disposed in the band. In this example embodiment, the hinge may be configured to be resonant in the frequency band of interest of the radiator carried by the band such that the radiator of the hinge may serve as a matching circuit and/or feed element for the radiator carried by the band. The radiator carried by the band may, in turn, transmit and/or receive signals from offboard the wearable device 10, such as at the same frequency or a different frequency from that at which the hinge is resonant and/or at the same power level or a different, e.g., greater, power level. In another example embodiment, the hinge may serve as a radiator to couple with multiple further radiators disposed in the band, thereby permitting operation in multiple frequency bands. For example, the further radiators carried by the band may, in turn, transmit and/or receive signals from offboard the wearable device 10 at multiple different resonant frequencies. It should be understood that an antenna or radiator may be configured to resonate at one or more operational resonant frequency either of its own accord, for example, by having two or more radiating elements of different physical and/or electrical lengths, or by having a single radiating element having a single physical and/or electrical length which is tuned to one or more resonant frequencies by processor controlled tuning circuitry comprising one or more reactive elements. It should also be understood that an antenna or radiator may be configured to have a predefined bandwidth which may cover more than one operational resonant frequency in one or more operational radio bands.

The first and second conductive pin elements 26, 28 may be biased, e.g., spring loaded, so as to urge the opposed ends of the first and second conductive pin elements outwardly from one another and into engagement with the wearable body 12. By being spring loaded, the ends of the first and second conductive pin elements may be deflected, such as by being depressed toward one another, to facilitate the initial engagement and the subsequent disengagement of the hinge 18 and, in turn, the band 16 from the wearable body. In this example embodiment, the biasing member, such as a spring element, may be disposed within the outer conductors 30 of the first and second conductive pin elements or exterior to the outer conductors of the first and second conductive pin elements, but within the insulator 38 that surrounds the first and second conductive pin elements.

In another example embodiment, a hinge 18 may be differently configured so as to have capacitive reactance, instead of inductive reactance, for a certain operational bandwidth. However, the hinge of this other example embodiment may continue to both mechanically engage a wearable body 12 and to serve as a radiator. In this example embodiment depicted in FIGS. 6 and 7, the hinge includes first and second conductive pin elements 50, 52 having respective ends 56 that are configured to mechanically engage the wearable body of a wearable device 10, such as by engaging the holes 24 defined by the tabs 22 of the chassis 14 of the wearable body. The first and second conductive pin elements may be formed of a metal, such as gold or gold plating.

At least one end and, in some embodiments, both ends 56 of the first and second conductive pin elements 50, 52 may be configured to be deflected, thereby facilitating the initial engagement of the hinge 18 with the wearable body 12 and the subsequent disengagement of the hinge from the wearable body. In this example embodiment, the ends of the first and second conductive pin elements may be spring loaded. For example, the first and second conductive pin elements may define internal cavities 58 and may include respective biasing members 60, such as respective springs, disposed within the internal cavities that are configured to bias the respective ends outwardly and into mechanical engagement with the wearable body.

In this example embodiment, the first and second conductive pin elements 50, 52 may each include a body that defines the internal cavity 58. The body of each conductive pin element may also define an opening into the internal cavity through which the respective end 56 extends. Both the body and the end of a respective pin element may be formed of a metal, such as gold. The respective ends 56 of the first and second conductive pin elements are captured within the internal cavity of the body, but are separate components and configured to move relative to the body, such as based upon deflection forces applied to the respective ends 56. In this regard, the end may include a base portion that is disposed within the body, that is, within the internal cavity defined by the body of a conductive pin element. The base portion of the end may be larger than the opening defined by the body such that the base portion is retained within the internal cavity even as the biasing member 60 operatively engages the base portion and urges the end outwardly. The end of this example embodiment also includes a protruding portion that is sized and shaped to extend through the opening defined by the body of the conductive pin element, and also sized and shaped to be received by and to mechanically engage with the wearable device 10, that is, the hole 24 defined by a tab 22 of the wearable body 12. As such, the end 56 is configured to be biased by the biasing member 60 outwardly through the opening defined by the body of the conductive pin element, but also to be deflected, such as due to deflection forces applied to the end, such as during engagement and disengagement with the wearable device.

The hinge 18 of this example embodiment also includes an insulator 54 positioned between the first and second conductive pin elements 50, 52. The insulator may be formed of a plastic so as to electrically isolate the first and second conductive pin elements. As illustrated in FIGS. 6 and 7, the first and second conductive pin elements extend in opposite directions from the insulator to the respective ends 56. In the embodiment depicted in FIG. 7, the first conductive pin also includes an interior end 62, opposite the end that is in mechanical engagement with the wearable body 12. The interior end closes the internal cavity 60 of the first conductive pin element. Additionally, the internal end of the first conductive pin element is disposed within the internal cavity of the second conductive pin element. In order to electrically isolate the interior end of the first conductive pin element from the second conductive pin element, the insulator may be configured to extend therebetween, such as shown in FIG. 7.

The hinge 18, such as the first conductive pin element 50, may serve as a radiator, such as an electrically small antenna, having capacitive reactance for a certain operational bandwidth. In this regard, the length of the first conductive pin may at least partially define the extent of a capacitive reactance. Thus, the behavior of the radiator, such as the frequency at which the radiator resonates, may be defined, at least in part, by the length of the first conductive pin element, as measured from the end 56 to the interior end 62 of the first conductive pin element.

In an example embodiment, the respective ends 56 of the first and second conductive pin elements 50, 52 are each configured to mechanically engage the wearable body 12, such as holes 24 defined by tabs 22 of the chassis 14 of the wearable body. As described above in conjunction with the embodiment of FIGS. 3 and 4, the end of the first conductive pin element may not only mechanically engage the wearable body, but may also be in electrical communication with RF circuitry, such as a transmitter and/or receiver, e.g., a transceiver, carried by the wearable body, such as a result of an electrical coupling established between the end of the first conductive pin element and a conductive trace or other conductor, e.g., matching circuit, carried by the chassis of the wearable body and extending to the circuitry, such as a transmitter and/or receiver, carried by the chassis. Conversely, the end of the second conductive pin element may similarly mechanically engage the wearable body, but may be electrically isolated from the wearable body and the PWB, such as a result of an insulative coating, e.g., a plastic coating, covering the end of the second conductive pin element. As such, the hinge 18 of this embodiment including the first conductive pin element may serve as a single-ended monopole or a near-field coupling or excitation element for another radiator. Alternatively, the end of the second conductive pin element may also be electrically coupled to the wearable body, such as the chassis of the wearable body. In this regard, the hinge may serve as a balanced dipole in which end of the second conductive pin element is coupled via the chassis to another terminal of the RF circuitry, opposite the terminal to which the end of the first conductive pin element is coupled.

As a result of its electrical coupling to circuitry, such as a transmitter and/or a receiver, carried by the wearable body 12, the hinge 18, such as the first conductive pin element 50, may serve as a radiator with capacitive reactance for a certain operational bandwidth so as to transmit and/or receive signals, such as at a relatively high frequency, thereby supporting communications offboard the wearable device 10. Alternatively and as also described above in conjunction with the embodiment of FIGS. 3 and 4, the radiator of the hinge may be configured to communicate, such as by electromagnetic coupling, with another radiator 20, such as carried by the band 16 of the wearable device, such as by resonating at a frequency of interest of the other radiator. The other radiator may, in turn, further communicate, such as at the same frequency, a different frequency and/or with increased power. As such, the radiator of the hinge of this example embodiment may serve as a matching circuit and/or feed element for the other radiator. By way of example, the Smith chart of FIG. 8 illustrates the capacitive reactance of the radiator embodied by the hinge of one example embodiment.

The hinge 18 and its associated radiating element may be configured to operate in at least one operational frequency band. For example, at least one of the following operational frequency bands (but are not limited to) Long Term Evolution (LTE) (B17 (DL:734-746 MHz; UL:704-716 MHz), B5 (DL:869-894 MHz; UL: 824-849 MHz), B20 (DL: 791-821 MHz; UL: 832-862 MHz), B8 (925-960 MHz; UL: 880-915 MHz) B13 (DL: 746-756 MHz; UL: 777-787 MHz), B28 (DL: 758-803 MHz; UL: 703-748 MHz), B7 (DL: 2620-2690 MHz; UL: 2500-2570 MHz), B38 (2570-2620 MHz), B40 (2300-2400 MHz) and B41 (2496-2690 MHz)), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz), inductive power standard (Qi) frequencies.

As described above, the hinge 18 of example embodiments not only serves to mechanically couple a band 16 to a wearable body 12 of a wearable device 10, but also serves as a radiator due to its inductive or capacitive reactance so as to facilitate communication, such as offboard the wearable device. In an embodiment in which the conductive pins 50, 52 of the hinge are coupled to the body and, in turn, to the RF circuitry, such as a transmitter and/or receiver, carried by the body, the radiator embodied by the hinge, in cooperation with the other components, may form a loop antenna, such as a balanced loop or an unbalanced loop as described above. Alternatively, the hinge of other embodiments may define a galvanically isolating gap between the first and second conductive pins such that the hinge may be configured as either a monopole or a balanced dipole as also described above. In doing so, the hinge may support enhanced functionality of the wearable device without any compromise in the mechanical performance and/or ornamental or aesthetic qualities of the wearable device. Further, the radiator described herein is capable of being used with a fully conductive body of a portable electronic device, not just a wearable device, without having to make significant design alterations to the industrial design or look of the device, e.g. without making large openings or holes in the body for radiation to be directed therethrough.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For example, although described herein in conjunction with a wearable device 10, the hinge 18 of an example embodiment may be embodied by other types of devices, such as a portable electronic device. In an instance in which the hinge is embodied by a non-wearable device, the device may not include a band 16, but may, instead, include a device housing or a body part, such as a molded plastic case including a further conductor, e.g., a transceiver, a conductive case or a lanyard strap that includes the further conductor, as non-limiting examples. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A hinge of a device that serves as a radiator, the hinge comprising:

first and second conductive pin elements, wherein opposite ends of the first and second conductive pin elements are configured to mechanically engage the device; and an insulator between portions of the first and second conductive pin elements, wherein the end of at least the first conductive pin element is also configured to be in electrical communication with radio frequency circuitry of the device such that the first conductive pin element comprises a radiating element.

2. A hinge according to claim 1 wherein the first and second conductive pin elements extend in opposite directions from the insulator to the ends that are configured to mechanically engage the device.

3. A hinge according to claim 1 wherein the first and second conductive pin elements comprise an outer conductor that defines an interior passageway that extends in a lengthwise direction and an inner conductor that extends at least partially through the interior passageway, wherein at least one of the first and second conductive pin elements further comprise a shielding within the interior passageway between the outer conductor and the inner conductor.

4. A hinge according to claim 3 wherein the inner conductor of the first conductive pin element comprises the end that is configured to be in electrical communication with the radio frequency circuitry.

5. A hinge according to claim 4 wherein the inner conductor is galvanically coupled to the outer conductors of the first and second conductive pin elements.

6. A hinge according to claim 3 wherein the insulator defines a passageway therethrough through which the inner conductor extends.

7. A hinge according to claim 3 wherein a galvanically isolating gap is defined between the first and second conductive pin elements.

8. A hinge according to claim 1 wherein the first and second conductive pin elements comprise respective biasing members configured to bias the ends away from the insulator and into mechanical engagement with the device.

9. A hinge of a device that serves as a radiator, the hinge comprising:

first and second conductive pin elements, wherein the first and second conductive pin elements comprise an outer conductor that defines an interior passageway that extends in a lengthwise direction and an inner conductor that extends at least partially through the interior passageway, wherein at least one of the first and second conductive pin elements further comprise a shielding within the interior passageway between the outer conductor and the inner conductor; and an insulator between the outer conductors of the first and second conductive pin elements with the first and second conductive pin elements extending in opposite directions from the insulator to respective ends that are configured to mechanically engage the device, wherein the end of at least the first conductive pin element is also configured to be in electrical communication with radio frequency circuitry of the device such that the first conductive pin element comprises a radiating element.

10. A hinge according to claim 9 wherein the inner conductor of the first conductive pin element comprises the end that is configured to be in electrical communication with the radio frequency circuitry.

11. A hinge according to claim 10 wherein the inner conductor is coupled to the outer conductor of the second conductive pin element.

12. A hinge according to claim 9 wherein the insulator defines a passageway therethrough through which the inner conductor extends.

13. A hinge according to claim 12 wherein at least a portion of the passageway defined by the insulator is larger than the inner conductor such that a gap is defined between the inner conductor and the insulator.

14. A hinge according to claim 9 wherein the insulator is disposed between the first and second conductive pin elements and surrounds at least portions of the first and second conductive pin elements.

15. A hinge according to claim 9 wherein the device comprises a wearable body and a band, wherein the respective ends of the first and second conductive pin elements are each configured to mechanically engage the wearable body, and wherein the hinge is configured to be operatively coupled to the band.

16. A hinge of a device that serves as a radiator, the hinge comprising:

first and second conductive pin elements comprising respective ends, wherein at least one end is configured to be deflected; and an insulator between portions of the first and second conductive pin elements with the first and second conductive pin elements extending in opposite directions from the insulator to the respective ends that are configured to mechanically engage the device, wherein the end of at least the first conductive pin element is also configured to be in electrical communication with radio frequency circuitry of the device such that the first conductive pin element comprises a radiating element.

17. A hinge according to claim 16 wherein the first and second conductive pin elements comprise respective biasing members configured to bias the respective ends away from the insulator and into mechanical engagement with the device.

18. A hinge according to claim 16 wherein the first and second conductive pin elements define internal cavities with the respective ends disposed at least partially within the internal cavities.

19. A hinge according to claim 18 wherein the first conductive pin further comprises an interior end, opposite the end that is in mechanical engagement with the device, wherein the interior end closes the internal cavity of the first conductive pin and is disposed within the internal cavity of the second conductive pin, and wherein the interior end of the first conductive pin is separated from the second conductive pin by the insulator.

20. A hinge according to claim 16 wherein the device comprises a wearable body and a band, wherein the respective ends of the first and second conductive pin elements are each configured to mechanically engage the wearable body, and wherein the hinge is configured to be operatively coupled to the band.

21. A hinge according to claim 1 wherein the device comprises at least one of a portable electronic device or a wearable device.

* * * * *